US009865190B2

(12) United States Patent
Lee

(10) Patent No.: US 9,865,190 B2
(45) Date of Patent: Jan. 9, 2018

(54) DISPLAY UNIT WITH A SAFETY FUNCTION

(71) Applicant: Hydis Technologies Co., Ltd., Gyeonggi-do (KR)

(72) Inventor: Jung Tae Lee, Gyeonggi-do (KR)

(73) Assignee: HYDIS TECHNOLOGIES CO., LTD., Gyeonggi-Do (KR)

( * ) Notice: Subject to any disclaimer, the term of this patent is extended or adjusted under 35 U.S.C. 154(b) by 71 days.

(21) Appl. No.: 15/007,927

(22) Filed: Jan. 27, 2016

(65) Prior Publication Data

US 2016/0225338 A1 Aug. 4, 2016

(30) Foreign Application Priority Data

Jan. 30, 2015 (KR) ..... 10-2015-0015144

(51) Int. Cl.
*G09G 3/3275* (2016.01)
*G09G 3/20* (2006.01)

(52) U.S. Cl.
CPC ..... *G09G 3/20* (2013.01); *G09G 3/3275* (2013.01); *G09G 2330/08* (2013.01); *G09G 2370/08* (2013.01); *G09G 2380/12* (2013.01)

(58) Field of Classification Search
None
See application file for complete search history.

(56) References Cited

U.S. PATENT DOCUMENTS 7,528,811 B2 * 5/2009 Iwabuchi ..... G09G 3/20 345/103
2011/0148825 A1 * 6/2011 Ueno ..... G09G 3/006 345/204
2016/0140927 A1 * 5/2016 Maruyama ..... G09G 3/2007 345/89
2016/0148599 A1 * 5/2016 Lim ..... G09G 3/20 345/212
2016/0196795 A1 * 7/2016 Kim ..... G09G 3/3648 345/211

FOREIGN PATENT DOCUMENTS

JP 2006-11024 1/2006
KR 10-2005-0051813 6/2005

* cited by examiner

*Primary Examiner* — Christopher Kohlman
(74) *Attorney, Agent, or Firm* — Young & Thompson

(57) ABSTRACT

Provided herein is a display panel where a plurality of data lines intersect a plurality of gate lines, thereby each forming a unit pixel area; a first data driving unit connected to one side of the plurality of data lines; a second data driving unit connected to another side of the plurality of data lines; a first gate driving unit connected to one side of the plurality of gate lines; and a second gate driving unit connected to another side of the plurality of gate lines, wherein the display panel is driven by one of a first driving channel that includes the first data driving unit and first gate driving unit, and a second driving channel that includes the second data driving unit and second gate driving unit.

9 Claims, 8 Drawing Sheets

FIG. 10

| | | POWER/ SIGNAL SUPPLY | DRIVING CHANNEL | SIGNAL CONTROL UNIT | | DATA DRIVING UNIT | DATA DRIVING UNIT | GATE DRIVING UNIT | GATE DRIVING UNIT |
|---|---|---|---|---|---|---|---|---|---|
| | | | | 41 | 51 | 11 | 13 | 12 | 14 |
| POWER/ SIGNAL METHOD 1 | FIRST EMBODIMENT | DRIVING CHANNEL A: On<br>DRIVING CHANNEL B: Off | A | Operating | OFF | Operating | OFF | Operating | OFF |
| | | DRIVING CHANNEL A: Off<br>DRIVING CHANNEL B: On | B | OFF | Operating | OFF | Operating | OFF | Operating |
| | SECOND EMBODIMENT | DRIVING CHANNEL A: On<br>DRIVING CHANNEL B: Off | A | Operating | OFF | Operating | OFF | Operating | Operating |
| | | DRIVING CHANNEL A: Off<br>DRIVING CHANNEL B: On | B | OFF | Operating | OFF | Operating | Operating | Operating |
| | THIRD EMBODIMENT | DRIVING CHANNEL A: On<br>DRIVING CHANNEL B: Off | A | Operating | OFF | Operating | OFF | Operating | |
| | | DRIVING CHANNEL A: Off<br>DRIVING CHANNEL B: On | B | OFF | Operating | OFF | Operating | Operating | |
| POWER/ SIGNAL METHOD 2 | FIRST EMBODIMENT | DRIVING CHANNEL A: On<br>DRIVING CHANNEL B: On | A | Operating | Operating | Operating | Hi-Z | Operating | Hi-Z |
| | | DRIVING CHANNEL A: On<br>DRIVING CHANNEL B: On | B | Operating | Operating | Hi-Z | Operating | Hi-Z | Operating |
| | SECOND EMBODIMENT | DRIVING CHANNEL A: On<br>DRIVING CHANNEL B: On | A | Operating | Operating | Operating | Hi-Z | Operating | Operating |
| | | DRIVING CHANNEL A: On<br>DRIVING CHANNEL B: On | B | Operating | Operating | Hi-Z | Operating | Operating | Operating |
| | THIRD EMBODIMENT | DRIVING CHANNEL A: On<br>DRIVING CHANNEL B: On | A | Operating | Operating | Operating | Hi-Z | Operating | |
| | | DRIVING CHANNEL A: On<br>DRIVING CHANNEL B: On | B | Operating | Operating | Hi-Z | Operating | Operating | |

DISPLAY UNIT WITH A SAFETY FUNCTION

CROSS-REFERENCE TO RELATED APPLICATION

This application claims the benefit of priority under 35 U.S.C. §119(a) of Korean Patent Application No. 10-2015-0015144, filed on Jan. 30, 2015, in the Korean Intellectual Property Office, the entire disclosure of which is incorporated herein by reference for all purposes.

BACKGROUND

1. Field

The following description relates to a display unit, and more particularly, to a display unit capable of implementing safety functions for a screen displaying important information in special applications such as aircrafts and the like, without a degradation in degree of resolution.

2. Description of Related Art

In special applications such as aircrafts and the like, significantly important information may be displayed on a display device. Thus, in the event that information is not displayed on a display device due to a breakdown in partial components of the device, severe risks may be caused in the safety of the special applications.

In particular, a significant defect may not be caused in the overall transmission of information in the case that a portion of pixels is defective. However, the overall information may not be displayed in the event that a system for driving a display device is defective, to thereby cause further severe problems. Thus, it may be required for display devices to have safety functions so as to display information even in the case that a portion of the system is defective.

In connection with this, according to the related art, safety functions are implemented through a method of manufacturing a single large scale screen by attaching two independent display devices to each other, that is, a method of using a single screen by attaching two independent panels having dimensions of 10"×10" to each other in a case in which the screen has dimensions of 20"×10", or a method of dividing a single panel into two panels and displaying information only on one panel having no defects in the event that the other panel and a system therefor are problematic as described in publication US2013120664.

In addition, in publication US20130276037, safety functions are implemented by a method of providing two pairs or four pairs of RGB components in each pixel region and allowing the pixel region to be driven by two systems to thereby drive a display device using one system in the case that a partial pixel region of a panel or the other one of the systems is defective.

However, in the methods as described above, in the case of the occurrence of defects, only a portion of a display screen must be used. Further, a plurality of pairs of RGB components are provided in each pixel region and only a portion thereof may be used to display information, whereby a degradation in degree of resolution may be caused in displaying important information.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A purpose of the present disclosure is to provide a display device having safety functions.

Another purpose of the present disclosure is to provide a display device capable of continuously performing display functions even in the case where a driving channel is defective.

Another purpose of the present disclosure is to provide a display device capable of implementing safety functions without a degradation in degree of resolution.

The aforementioned purposes of the present disclosure and other purposes may all be accomplished by a display device having safety functions according the present disclosure.

According to an aspect, there is provided a display device having safety functions, the device including a display panel where a plurality of data lines intersect a plurality of gate lines, thereby each forming a pixel unit area; a first data driving unit connected to one side of the plurality of data lines; a second data driving unit connected to another side of the plurality of data lines; and a first gate driving unit connected to one side of the plurality of gate lines, wherein the display panel is driven by one of driving channels which comprise a first driving channel that includes the first data driving unit and first gate driving unit and a second driving channel that includes the second data driving unit and first gate driving unit.

The display device may further include a second gate driving unit connected to another side of the plurality of gate lines, and the first driving channel and second driving channel may further include the second gate driving unit.

The display panel may be driven by one of the first driving channel and second driving channel to which power and signals are being input from outside.

The display device may further include a channel switch configured to supply the power and signals being input from outside to the first driving channel or second driving channel selectively.

The first driving channel and second driving channel may be being supplied with power and signals from outside, and the data driving unit included in the one of the driving channels may output data signals to the plurality of data lines, and the data driving unit included in the other of the driving channels may be in a high impedance state.

Each of the first driving channel and second driving channel may further include a signal control unit configured to provide control signals to the data driving unit and gate driving unit included in each driving channel, a first storage unit configured to store normal state signal information, and a second storage unit configured to store high impedance state signal information, and the signal control unit in the one of the driving channels may provide normal control signals with reference to the first storage unit, and the signal control unit in the other of the driving channels may provide a high impedance control signal with reference to the second storage unit.

According to an aspect, there is provided a display device having safety functions, the device including a display panel where a plurality of data lines intersect a plurality of gate lines, thereby each forming a unit pixel area; a first data driving unit connected to one side of the plurality of data lines; a second data driving unit connected to another side of the plurality of data lines; a first gate driving unit connected to one side of the plurality of gate lines; and a second gate driving unit connected to another side of the plurality of gate lines, wherein the display panel is driven by one of driving channels which comprise a first driving channel that includes the first data driving unit and first gate driving unit and a second driving channel that includes the second data driving unit and second gate driving unit, and the data driving unit and gate driving unit included in the one of the driving channels output data signals and gate signals to the plurality of data lines and to the plurality of gate lines, respectively, and the data driving unit and gate driving unit included in the other of the driving channels are in a high impedance state.

Each of the first driving channel and second driving channel may further include a signal control unit configured to provide control signals to the data driving unit and gate driving unit included in each driving channel, a first storage unit configured to store normal state signal information, and a second storage unit configured to store high impedance state signal information, and the signal control unit in the one of the driving channels may provide normal control signals with reference to the first storage unit, and the signal control unit in the other of the driving channels may provide a high impedance control signal with reference to the second storage unit.

The present disclosure has an effect of providing a display device having safety functions capable of continuously displaying information without a degradation of resolution even when a driving channel is defective.

Other features and aspects will be apparent from the following detailed description, the drawings, and the claims.

BRIEF DESCRIPTION OF THE DRAWINGS

The above and other aspects, features and other advantages of the present invention will be more clearly understood from the following detailed description taken in conjunction with the accompanying drawings, in which:

FIG. 10 is a table illustrating whether or not each component is operating in each power/signal method and embodiments thereof.

DETAILED DESCRIPTION

Hereinafter, explanation will be made in detail on a display device having safety functions according to the present disclosure with reference to the drawings attached.

The following detailed description will include only the components required for those skilled in the art to understand the device according to the embodiments of the present disclosure, and explanation on other parts will be omitted so as not to obscure the essence of the present disclosure.

Furthermore, the terms and words used in this specification and the attached claims are not to be construed as being limited to general or lexical meanings, but are to be construed as meanings and concepts that are in line with the technical idea of the present disclosure so as to most appropriately describe the present disclosure.

Furthermore, in various embodiments, components having the same configurations will be explained representatively with reference to the first embodiment, and in other embodiments, only the components different from the first embodiment will be explained.

Figure 1:
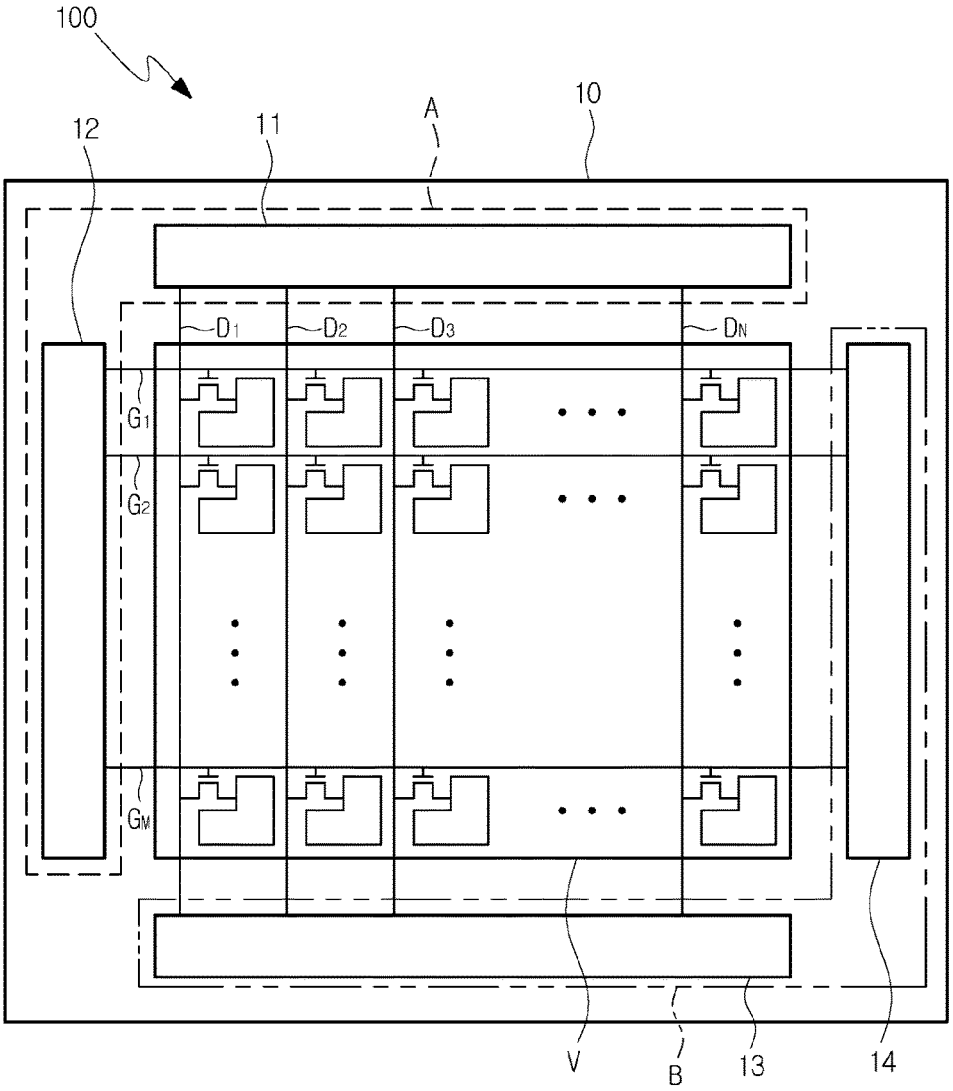
FIG. 1 is a view schematically illustrating a display device according to a first embodiment of the present disclosure.

FIG. 1 is a view schematically illustrating a display device according to a first embodiment of the present disclosure.

As illustrated in FIG. 1, the display device 100 according to the first embodiment of the present disclosure 100 is configured to include a display panel 10, first driving channel A and second driving channel B.

The display panel 10 is a device for displaying information on a visible area V, and a plurality of data lines $D_1$ to $D_N$ and a plurality of gate lines $G_1$ to $G_M$ may intersect with each other to each form a unit pixel area in order to display information on the visible area.

The first driving channel A may be configured to include a first data driving unit 11 connected to one side of the plurality of data lines to supply data signals and a first gate driving unit 12 connected to one side of the plurality of gate lines to supply gate signals.

In the case of a general display device, a display panel thereof may be driven by a single driving channel. However, the display device according to an embodiment of the present invention may further include the second driving channel in preparation for the case in which information is inappropriately displayed on the display panel due to a breakdown in the first driving channel and the like.

The second driving channel B may be configured to include a second data driving unit 13 connected to another side of the plurality of data lines to supply data signals and a second gate driving unit 14 connected to another side of the gate lines to supply gate signals.

In such a display device according to an embodiment of the present invention, the first driving channel may be connected to the one side of the data lines and the one side of the gate lines to provide the signals required for displaying information, and in the case that the display of information on the display panel through the first driving channel is abnormal, signals required for displaying information may be provided by the second driving channel connected to the another side of the data lines and the another side of the gate lines. Thus, even in an abnormal case in which the first driving channel is abnormally operated, all pixel areas rather than a portion of the pixel areas, of the display panel may be normally operated, such that information may be displayed without a deterioration in degree of resolution.

Although it was explained that the second driving channel is an auxiliary driving channel, the same applies when the second driving channel is a driving channel that may be used in normal situations, and the first driving channel and second driving channel may be operated alternately even in non emergency situations.

Figure 2:
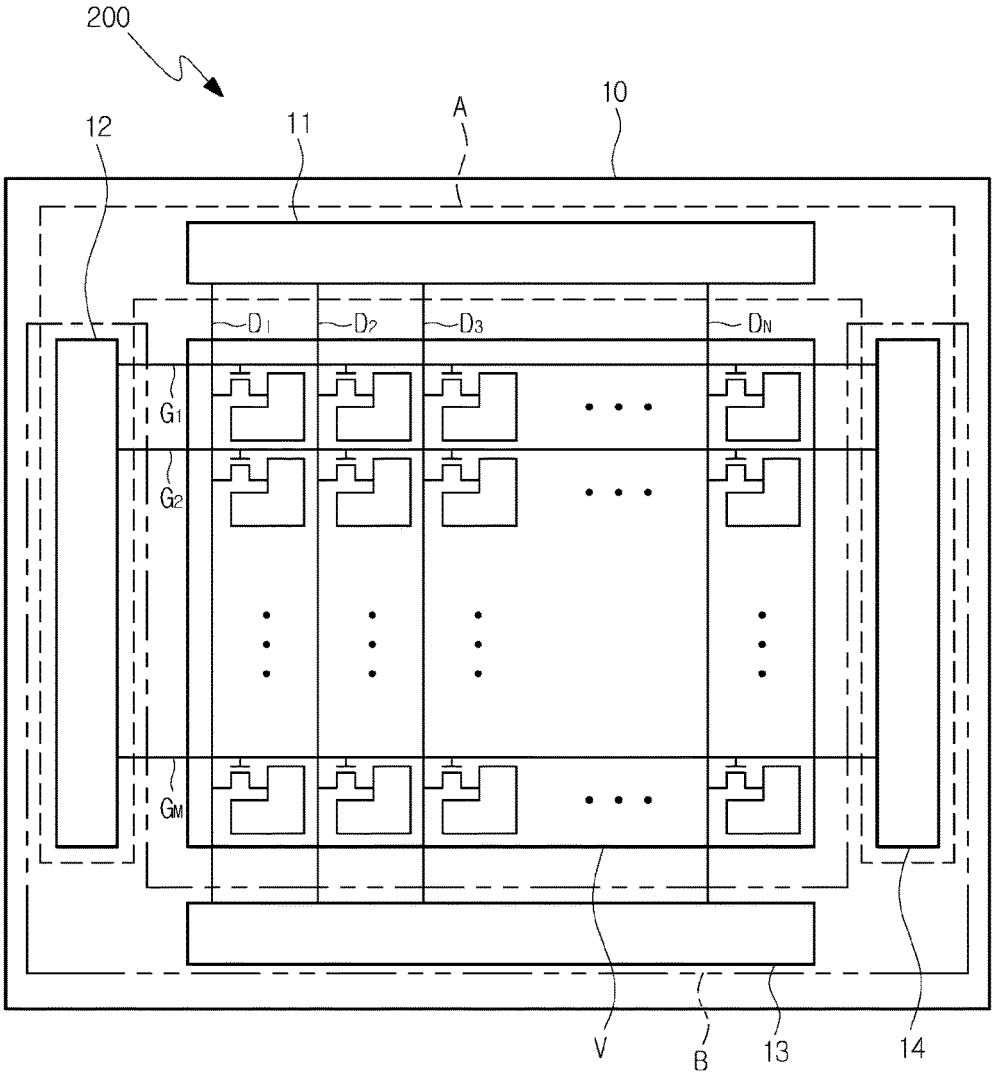
FIG. 2 is a view schematically illustrating a display device according to a second embodiment of the present disclosure.

FIG. 2 illustrates a schematic view of a display device according to a second embodiment of the present disclosure.

The display device 200 according to a second embodiment of the present disclosure includes a display panel 10, first driving channel A and second driving channel B just as the display device 100 according to the first embodiment of the present disclosure, and the display panel 10 is driven by one of the first driving channel A and second driving channel B.

Therefore, in response to the display panel not being driven normally due to a breakdown of the one of the driving channels after being driven by that driving channel, information may be displayed on the display panel 10 by the other driving channel without a degradation of resolution.

However, unlike in the first embodiment, the gate driving units 12, 14 of the second embodiment are both included in the first driving channel A and the second driving channel B. In other words, the first driving channel A is configured to include both the first gate driving unit 12 and the second gate driving unit 14, and the second driving channel B is also configured to include the first gate driving unit 12 and the second gate driving unit 14.

Therefore, in the display device 200 according to the second embodiment of the present disclosure, both the first gate driving unit 12 and second gate driving unit 14 supply gate signals to the plurality of gate lines regardless of which driving channel of the first driving channel A and second driving channel B drives the display panel 10.

In such a display device 200 according to the second embodiment of the present disclosure, gate signals are provided from both sides of the gate lines, and thus it possible to improve or prevent the degradation of resolution that may occur due to gate line delay when the panel size is big.

Herein, the gate ON voltage, gate OFF voltage and gate control signals being provided from both sides of the gate lines may desirably be output from one circuit component (for example, TCON) in order to match the sync.

Figure 3:
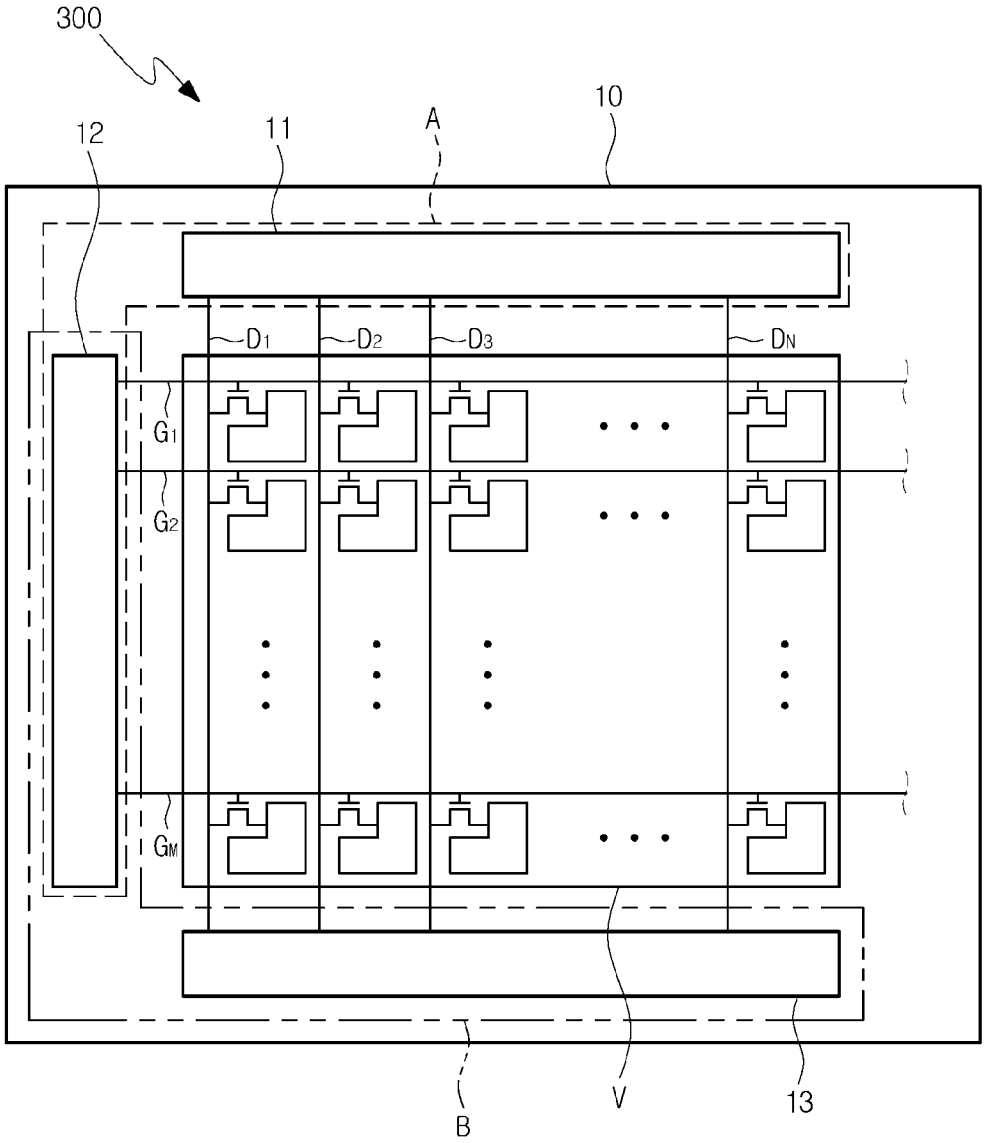
FIG. 3 is a view schematically illustrating a display device according to a third embodiment of the present disclosure.

FIG. 3 illustrates a schematic view of a display device according to a third embodiment of the present disclosure.

The display device 300 according to the third embodiment of the present disclosure includes a display panel 10, first driving channel A and second driving channel B just as the display devices 100, 200 according to the first and second embodiments, and the display panel 10 is driven by one of the first driving channel A and second driving channel B.

Therefore, in response to the display panel not being driven normally due to a breakdown of the driving channel after having been driven by that one driving channel, information may be displayed on the display panel 10 by the other driving channel without a degradation of resolution.

However, unlike in the first and second embodiments, a gate driving unit is disposed only one side of the plurality of gate lines, and the first gate driving unit 12 disposed on one side of the gate lines is included in both the first driving channel A and second driving channel B just as in the second embodiment.

Therefore, in the display device 300 according to the third embodiment, the first gate driving unit 12 supplies gate signals to the plurality of gate lines regardless of which driving channel of the first driving channel A and second driving channel B drives the display panel 10.

In such a display device 300 according to the third embodiment, gate signals are provided from only one side of the gate lines, and thus the display device 300 is suitable to be applied to a display device having a smaller panel than the second embodiment.

As aforementioned with reference to the first, second, and third embodiments, the display device according to an embodiment of the present disclosure is characterized to have two driving channels in case of emergencies when the information cannot be displayed on the display panel due to a breakdown of a driving channel.

Figure 4:
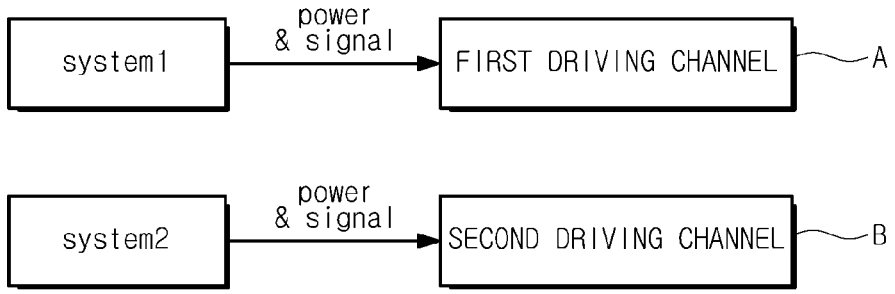
FIG. 4 is a view illustrating an exemplary connection relationship between a system for supplying power/signals and a driving channel.

These two driving channels A, B may each be provided with power and signals from an external system as illustrated in FIG. 4.

That is, in order for the display panel to be driven by the first driving channel A, power and signals are provided to the first driving channel A by an external system 1. Furthermore, in order for the display panel to be driven by the second driving channel B, power and signals are provided to the second driving channel B by an external system 2.

Therefore, normally, power and signals may be provided to the first driving channel A by the system 1, but when the information is not normally displayed on the display panel due to a malfunction in the first driving channel A, power and signals may then be provided to the second driving channel B by the system 2 (or vice versa). Such operations of the systems 1, 2 may be selected manually by the user or may be automatically selected by information of a sensor that senses that information is not being displayed normally on the display panel.

Figure 5:
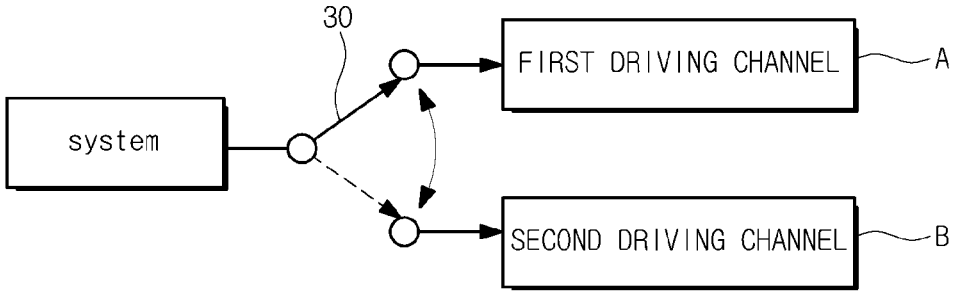
FIG. 5 is a view illustrating another exemplary connection relationship between a system for supplying power/signals and a driving channel.

FIG. 5 illustrates another exemplary connection relationship between a system that supplies power/signals and a driving channel.

Unlike in the embodiment illustrated in FIG. 4, the first and second driving channels A, B of the present disclosure may receive power and signals from one external system.

In such a case, it is desirable that the display device according to an embodiment of the present disclosure further includes a channel switch 30 configured to supply power and signals being input from outside to the first driving channel or second driving channel selectively, as illustrated in FIG. 5.

According to this embodiment, the display panel 10 of the present disclosure is driven by one driving channel being supplied with power and signals from an external system through the channel switch 30. Furthermore, when an abnormality occurs in the driving channel driving the display panel, the channel switch 30 inside the display panel is operated manually or automatically such that power and signals from the external system may be supplied to the other driving channel. Accordingly, even when an abnormality occurs in one driving channel, the display panel 10 may operate normally by the other driving channel.

Figure 6:
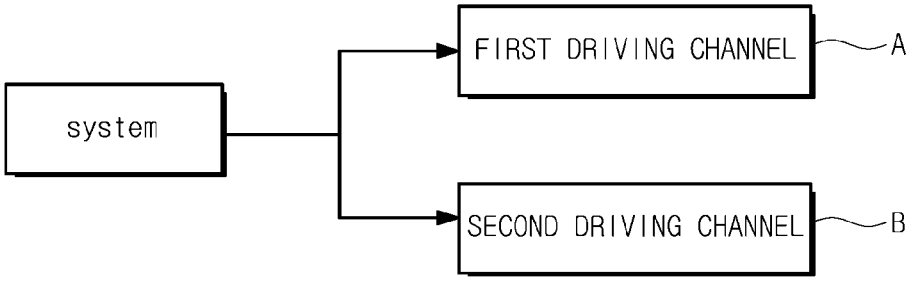
FIG. 6 is a view illustrating another exemplary connection relationship between a system for supplying power/signals and a driving channel.

FIG. 6 illustrates another exemplary connection relationship between a system that supplies power/signals and a driving channel.

Unlike in the embodiment illustrated in FIG. 5, the first and second driving channels A, B of the present disclosure may simultaneously receive power and signals from an external system.

In such a case, in order to allow the display panel 10 to be driven by only one of the first and second driving channels, while the display panel is being driven by one driving channel A, normal signals, that is data signals and gate signals are prevented from being supplied to the display panel 10 by the other driving channel B.

This will be explained in further detail hereinafter with reference to FIG. 7.

The first driving channel A includes a signal control unit 41 configured to provide control signals to each of the first data driving unit 11 and first gate driving unit 12, a first storage unit 42 configured to store normal state signal information and a second storage unit 43 configured to store high impedance state signal information.

Furthermore, the second driving channel B also includes a signal control unit 51 configured to provide control signals to each of the second data driving unit 13 and second gate driving unit 14, a first storage unit 52 configured to store normal state signal information, and a second storage unit 53 configured to store high impedance state signal information.

The signal control unit may be a TCON configured to supply control signals to the data driving unit and gate driving unit. The first and second storage unit may each be an EEPROM that stores signal information.

To the first and second driving channels A, B, power and signals are always being supplied from outside. However, in order for the display panel to be driven by only one of the first and second driving channels, the display device according to an embodiment of the present disclosures operates as will be explained hereinafter.

For example, in order to drive the display panel 10 by the first driving channel, the signal control unit 41 of the first driving channel provides a normal control signal to the first data driving unit 11 and first gate driving unit 12 with reference to the first storage unit 42 that stores normal state signal information. On the other hand, the signal control unit 51 of the second driving channel provides a high impedance control signal to the second data driving unit 13 and second gate driving unit 14 with reference to the second storage unit 53 that stores high impedance state signal information.

Figure 8:
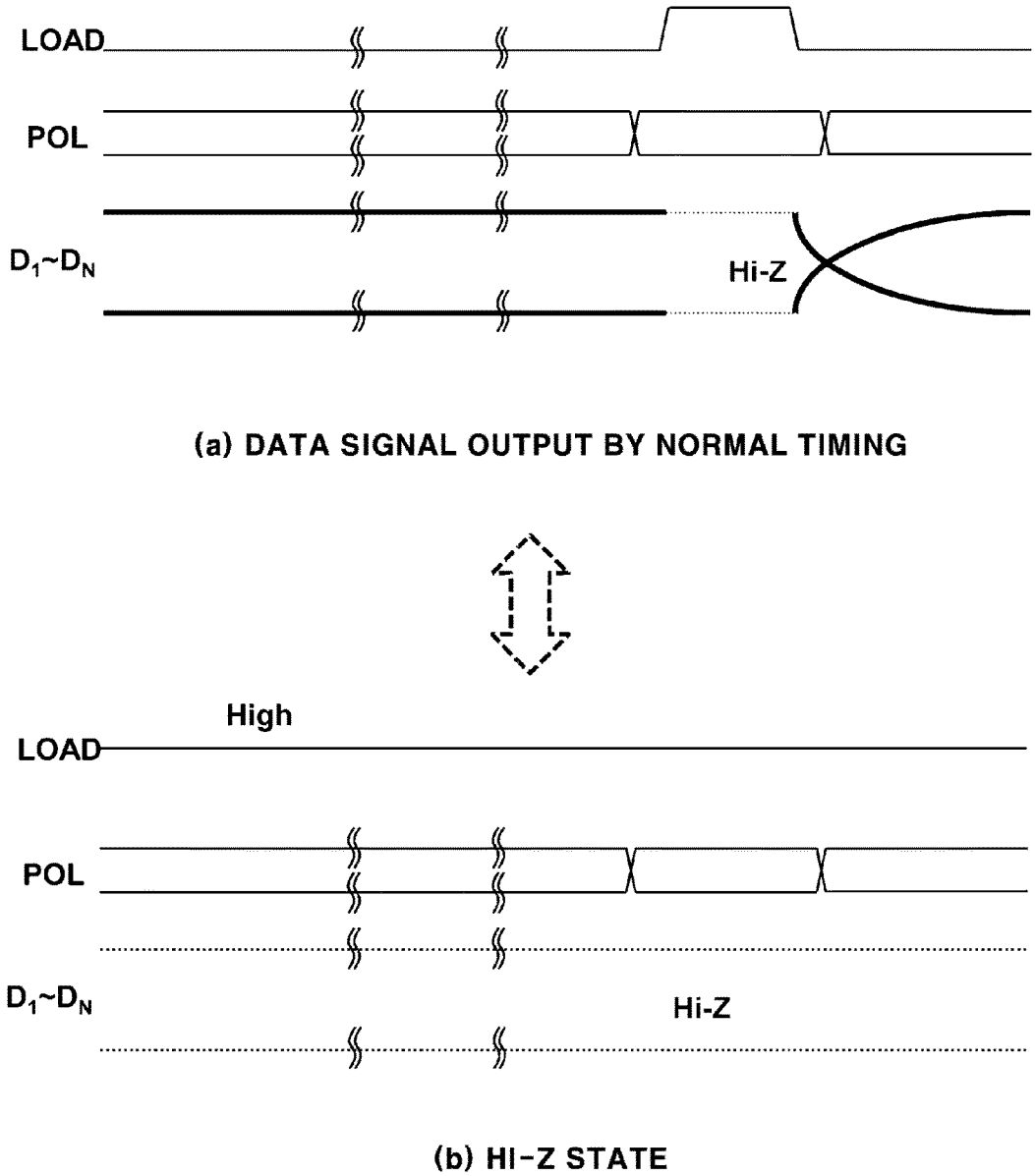
FIG. 8 is a view illustrating data signal output at a normal timing and a high impedance state.

In such a case, the first data driving unit 11 normally outputs data signals to the plurality of data lines (see FIG. 8(*a*)), and the first gate driving unit 12 normally outputs gate signals to the plurality of gate lines. However, the second data driving unit 12 and second gate driving unit 14 fall into a high impedance state (Hi-Z state), and thus do not output a data signal nor gate signal (see FIG. 8(*b*)).

Figure 9:
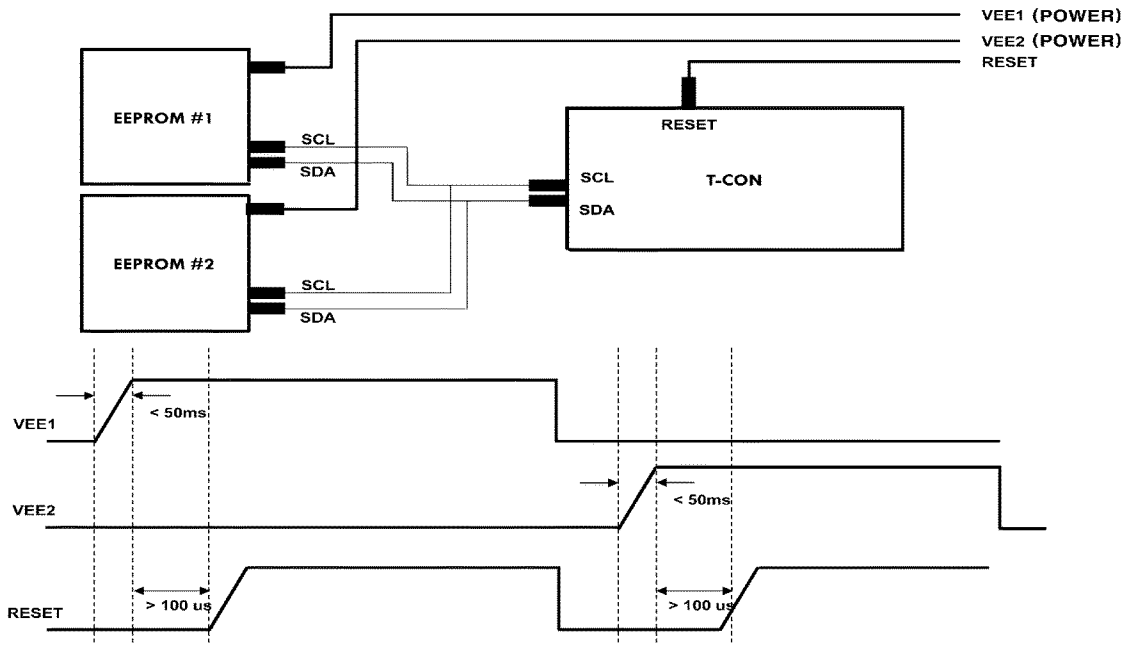
FIG. 9 is a view illustrating a connection relationship between a signal control unit and a first and second storage units.

Then, when an abnormality occurs in the driving channel driving the display panel, it is possible to change the driving channel for driving the display panel in a manner of, for example, providing a reset signal to the signal control units 41, 51 as illustrated in FIG. 9.

That is, when a reset signal is provided to the signal control units 41, 51, the signal control unit 41 of the first driving channel A that used to provide a normal control signal with reference to the first storage unit 42 provides high impedance control signals to the first data driving unit 11 and first gate driving unit 12 with reference to the second storage unit 43. Furthermore, the signal control unit 51 of the second driving channel B that used to provide a high impedance control signal with reference to the second storage unit 53 provides normal control signals to the second data driving unit 13 and second gate driving unit 14 with reference to the first storage unit 52.

Therefore, the first data driving unit 11 and first gate driving unit 12 do not output a data signal nor gate signal, but the second data driving unit 13 outputs data signals to the plurality of data lines, and the second gate driving unit 14 outputs gate signals to the plurality of gate lines.

Figure 7:
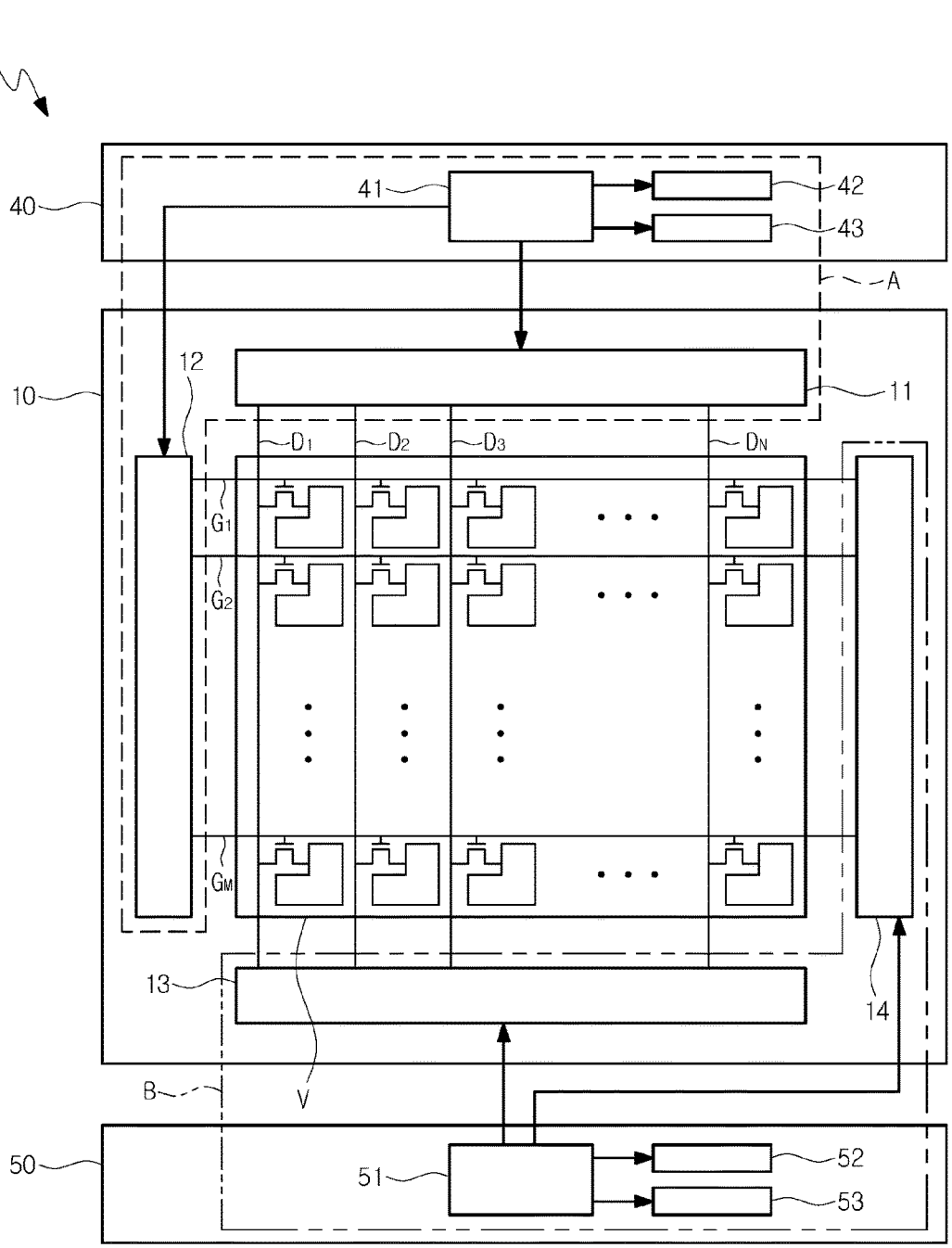
FIG. 7 is a view illustrating an exemplary driving channel for controlling a high impedance.

Although FIG. 7 illustrates a display device according to the first embodiment of the present disclosure, the same power/signal supply method (power/signal method 2) may also be applied to the display device according to the second and third embodiments.

Furthermore, the first driving channel A and second driving channel B may be configured to include the signal control units 41, 51 and storage units 42, 52 when applying the power/signal supply method (power/signal method 1) illustrated in FIG. 6, wherein there is no need to provide a second storage unit 43, 53 configured to store high impedance state signal information.

The states of the signal control units 41, 51, the first and second data driving units 11, 13, and the first and second gate driving units 12, 14 in the case of driving a display device according to the first, second, and third embodiments of the present disclosure by the aforementioned power/signal methods 1 and 2 are as illustrated in FIG. 10.

While this disclosure includes specific embodiments of a display device providing with safety functions according to various embodiments of the present disclosure, it will be apparent to one of ordinary skill in the art that various changes in form and details may be made in these embodiments without departing from the spirit and scope of the claims and their equivalents.

What is claimed is:

1. A display device having safety functions, the device comprising:

a display panel where a plurality of data lines intersect a plurality of gate lines, thereby each forming a pixel unit area;

a first data driving unit connected to one side of the plurality of data lines;

a second data driving unit connected to another side of the plurality of data lines; and a first gate driving unit connected to one side of the plurality of gate lines, wherein the display panel is driven by one of driving channels which comprise a first driving channel that comprises the first data driving unit and first gate driving unit and a second driving channel that comprises the second data driving unit and first gate driving unit, the first driving channel and second driving channel are being supplied with power and signals from outside, the data driving unit included in the one of the driving channels output data signals to the plurality of data lines, and the data driving unit included in the other of the driving channels is in a high impedance state, each of the first driving channel and second driving channel further comprises a signal control unit configured to provide control signals to the data driving unit and gate driving unit included in each driving channel, a first storage unit configured to store normal state signal information, and a second storage unit configured to store high impedance state signal information, and the signal control unit in the one of the driving channels provides normal control signals with reference to the first storage unit, and the signal control unit in the other of the driving channels provides a high impedance control signal with reference to the second storage unit.

2. The display device according to claim 1, further comprising a second gate driving unit connected to another side of the plurality of gate lines, and the first driving channel and second driving channel further comprise the second gate driving unit.

3. The display device according to claim 2, wherein the display panel is driven by one of the first driving channel and second driving channel to which power and signals are being input from outside.

4. The display device according to claim 3, further comprising a channel switch configured to supply the power and signals being input from outside to the first driving channel or second driving channel selectively.

5. The display device according to claim 1, wherein the display panel is driven by one of the first driving channel and second driving channel to which power and signals are being input from outside.

6. The display device according to claim 5, further comprising a channel switch configured to supply the power and signals being input from outside to the first driving channel or second driving channel selectively.

7. A display device having safety functions, the device comprising:

a display panel where a plurality of data lines intersect a plurality of gate lines, thereby each forming a unit pixel area;

a first data driving unit connected to one side of the plurality of data lines;

a second data driving unit connected to another side of the plurality of data lines;

a first gate driving unit connected to one side of the plurality of gate lines; and a second gate driving unit connected to another side of the plurality of gate lines, wherein the display panel is driven by one of driving channels which comprises a first driving channel that comprises the first data driving unit and first gate driving unit and a second driving channel that comprises the second data driving unit and second gate driving unit, the first driving channel and second driving channel are being supplied with power and signals from outside, the data driving unit and gate driving unit included in the one of the driving channels output data signals and gate signals to the plurality of data lines and to the plurality of gate lines, respectively, and the data driving unit and gate driving unit included in the other of the driving channels are in a high impedance state, each of the first driving channel and second driving channel further comprises a signal control unit configured to provide control signals to the data driving unit and gate driving unit included in each driving channel, a first storage unit configured to store normal state signal information, and a second storage unit configured to store high impedance state signal information, and the signal control unit in the one of the driving channels provides normal control signals with reference to the first storage unit, and the signal control unit in the other of the driving channels provides a high impedance control signal with reference to the second storage unit.

8. The display device according to claim 7, wherein the display panel is driven by one of the first driving channel and second driving channel to which power and signals are being input from outside.

9. The display device according to claim 8, further comprising a channel switch configured to supply the power and signals being input from outside to the first driving channel or second driving channel selectively.

* * * * *